US007370372B1

(12) United States Patent
Brewer

(10) Patent No.: US 7,370,372 B1
(45) Date of Patent: May 13, 2008

(54) GLOVE MOUNTED TEE HOLDING SYSTEM

(76) Inventor: Aaron F. Brewer, 13486 Campus Dr., Oakland, CA (US) 94619

( * ) Notice: Subject to any disclaimer, the term of this patent is extended or adjusted under 35 U.S.C. 154(b) by 0 days.

(21) Appl. No.: 11/581,325

(22) Filed: Oct. 16, 2006

(51) Int. Cl.
*A41D 19/00* (2006.01)

(52) U.S. Cl. ..... 2/160; 2/161.4; 24/3.2; 24/3.9

(58) Field of Classification Search ..... 2/160, 2/209.13, 161.1–161.4; 24/3.12, 3.2, 3.9; 224/218, 219, 918; 473/205
See application file for complete search history.

(56) References Cited

U.S. PATENT DOCUMENTS

| | | | | |
|---|---|---|---|---|
| 3,272,412 | A | 9/1966 | Antonious | |
| D251,037 | S | 2/1979 | Cudahy, III | |
| 4,475,676 | A * | 10/1984 | Smith | 224/247 |
| 4,639,947 | A | 2/1987 | Lanscioni | |
| 4,830,248 | A | 5/1989 | Pommenville | |
| 5,365,609 | A | 11/1994 | Herzog | |
| 5,433,436 | A | 7/1995 | Hoyt et al. | |
| 5,724,707 | A * | 3/1998 | Kirk et al. | 24/3.7 |
| 5,795,248 | A * | 8/1998 | Giglio | 473/406 |
| 6,168,057 | B1 * | 1/2001 | Schwabe | 224/269 |
| 6,205,588 | B1 | 3/2001 | Shin | |
| D453,418 | S | 2/2002 | Rippeon | |
| 6,421,836 | B1 | 7/2002 | Park | |
| 6,688,505 | B1 * | 2/2004 | Bradley et al. | 224/230 |
| 6,973,674 | B2 | 12/2005 | Jackson | |
| 2002/0010956 | A1 | 1/2002 | Roland | |

* cited by examiner

*Primary Examiner*—Katherine Moran
(74) *Attorney, Agent, or Firm*—Jeffrey A. Proehl; Woods, Fuller, Shultz & Smith PC

(57) ABSTRACT

A system for holding golf tees on a hand of a golfer, comprising a tee holding device removably mounted on a securing flap of a glove, and including a mounting portion for mounting on the securing flap of the glove and a tee receiving portion mounted on the mounting portion for removably receiving at least one golf tee. The mounting portion defines a slot with closed ends for receiving the flap. The system may include a glove with a securing flap for selectively securing together sections of a back portion of the glove located on opposite sides of an expansion slit.

18 Claims, 5 Drawing Sheets

GLOVE MOUNTED TEE HOLDING SYSTEM

BACKGROUND OF THE INVENTION

1. Field of the Invention

The present invention relates to golf tee holders and more particularly pertains to a new glove mounted tee holding system for providing quick and convenient access to golf tees on a hand of a golfer.

2. Description of the Prior Art

A golf tee is a wooden or plastic elongate device, less than four inches in length, used for elevating a golf ball above the playing surface. The benefits of elevating a player's golf ball for distance shots has been recognized for some time-before the invention of golf tees, golf balls were placed on mounds of sand, taken from "tee boxes." Modern golfers who follow the traditional rules of golf now use a golf tee to elevate their golf ball during the first shot of every hole. Because the golf tees are subject to extreme forces imparted by the head of a golf club, tees often break after use.

During game play, golfers can replace broken tees with spares that are stored in a compartment in a motorized golf cart or in a standard golf bag. These storage locations require the golfer to take the necessary steps to retrieve the stored tees when they are needed, however.

Golfers who desire access to a supply of tees on their person may maintain a collection of tees in a shirt or pants pocket. However, because tees are adapted for insertion into the ground with a sharp pointed end, storage in shirt and pants pockets can be uncomfortable. Not only are golfers subject to the hazard presented when tees pierce a pocket's wall, but they are also subject to injury incurred when the sharp end of a tee contacts a hand inserted into these storage pockets.

Furthermore, golfers who engage in the sport during inclement, wet weather must sometimes retrieve pocketed tees with a wet and soiled glove, imparting the moisture and dirt to the opening of the pocket.

With respect to these drawbacks, a number of tee holding devices have been devised. Specifically, implementations of tee holding devices have been created for attachment to golf gloves. The tee holding devices in the existing art, however, contain drawbacks that limit their usefulness by being bulky, awkward to use, complicated to manufacture and potentially hazardous to the user.

Prior to the instant invention, a number of attempts have been made to design tee holders that address the problems associated with storing and using golf tees. In U.S. Pat. No. 4,830,248 to Pommenville and U.S. Pat. No. 5,433,436 to Hoyt et al., devices for holding golf tees, pencils and other accessories are shown, featuring a clip to be received by a strap on a golf bag or on a golf shoe. The structures are such that one component of the device engages the surface to which the holder is attached, and the other component has some means for holding the tees.

U.S. Design Pat. No. 453,418 to Rippeon and U.S. Design Pat. No. 251,037 to Cudahy, III show golf tee holders with two major components-a tee holding component attached to a clip component, with the clip component frictionally engaging the material over which it is slid. These devices, when used in conjunction with a golf glove, impede wrist movement and add unnecessary bulk.

U.S. Pat. No. 3,272,412 to Antonious shows a carrier for golf tees and ball markers utilizing a flap which wraps around an object to which it is secured. This device is designed for carrying more equipment than golf tees, and is excessively bulky. The added structures for carrying ball markers also make this device more costly and complicated to manufacture.

U.S. Pat. No. 5,365,609 to Herzog and U.S. Patent Application No. 2002/0010956 show golf gloves with integral golf tee holding apparatuses. These devices are entire glove structures and cannot be attached to an existing golf glove. Thus, the tee holding apparatus must be replaced whenever the glove must be replaced.

U.S. Pat. No. 6,973,674 to Jackson, Jr. shows a glove-attached tee holder that consists of small elastic rings positioned on the side of the glove, opposite the thumb. This device is a modification to a golf glove instead of an attachment, and thus must be replaced when the glove is replaced.

U.S. Pat. No. 6,421,836 to Park and U.S. Pat. No. 6,205,588 to Shin show golfing gloves with attached tee carriers. These tee-holding devices are again integrated into the glove and are not removable or attachable to another glove.

U.S. Pat. No. 4,639,947 to Lanscioni shows a golf glove with a flap opposite the palm of the device for securing golf-related accessories. This device is not an accessory, but rather integrated into a glove.

In these respects, the glove mounted tee holding system according to the present invention substantially departs from the conventional concepts and designs of the prior art, and in so doing provides an apparatus primarily developed for the purpose of providing quick and convenient access to golf tees on a hand of a golfer.

SUMMARY OF THE INVENTION

In view of the foregoing disadvantages inherent in the known types of golf tee holders now present in the prior art, the present invention provides a new glove mounted tee holding system construction wherein the same can be utilized for providing quick and convenient access to golf tees on a hand of a golfer.

To attain this, the present invention generally comprises a system for holding golf tees on a hand of a golfer, comprising a glove, including an opening edge defining an opening for receiving the hand of the golfer; a front portion for positioning adjacent to a palm side of the hand of the golfer when worn; a back portion for positioning adjacent to a back side of the hand of the golfer when worn; a slit edge defining an expansion slit for permitting expansion of the opening; and a securing flap for selectively securing together sections of the back portion of the glove located on opposite sides of the expansion slit. The system also comprises a tee holding device removably mounted on the securing flap of the glove, receiving a portion of the securing flap of the glove. The tee holding device is made up of a mounting portion for mounting on the securing flap of the glove and a tee receiving portion for removably receiving at least one golf tee. The tee receiving portion is mounted on the mounting portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant object of the present invention is to provide a new glove mounted tee holding system that provides a user quick access to a supply of golf tees.

Yet another object of the present invention is to provide a new glove mounted tee holding system that is pliable and able to flex with the users hand to prevent the golf tees from abrading or puncturing the hand of the user.

Still yet another object of the present invention is to provide a new glove mounted tee holding system that is adapted to attach to a variety of golf gloves.

Even still another object of the present invention is to provide a new glove mounted tee holding system that is compact and does not interfere with wrist flexibility during a golf swing.

Even yet another object of the present invention is to provide a new glove mounted tee holding system that will mate with both golf gloves for right-handed as well as left-handed golfers.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
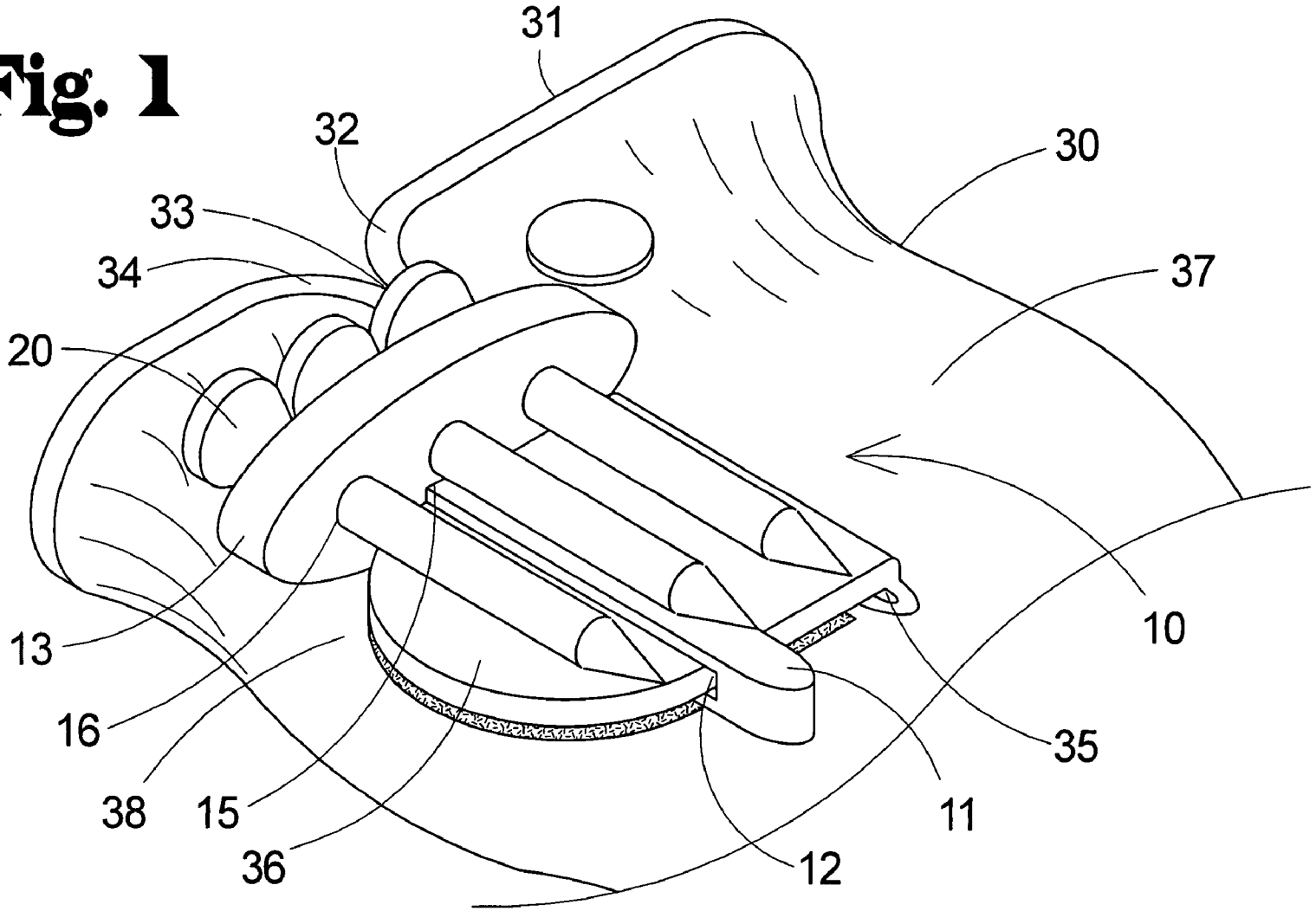
FIG. 1 is a perspective view of the glove mounted tee holding system mounted on a golf glove.

With reference now to the drawings, and in particular to FIGS. 1 through 5 thereof, a new glove mounted tee holding system embodying the principles and concepts of the present invention and generally designated by the reference numeral 10 will be described.

Figure 2:
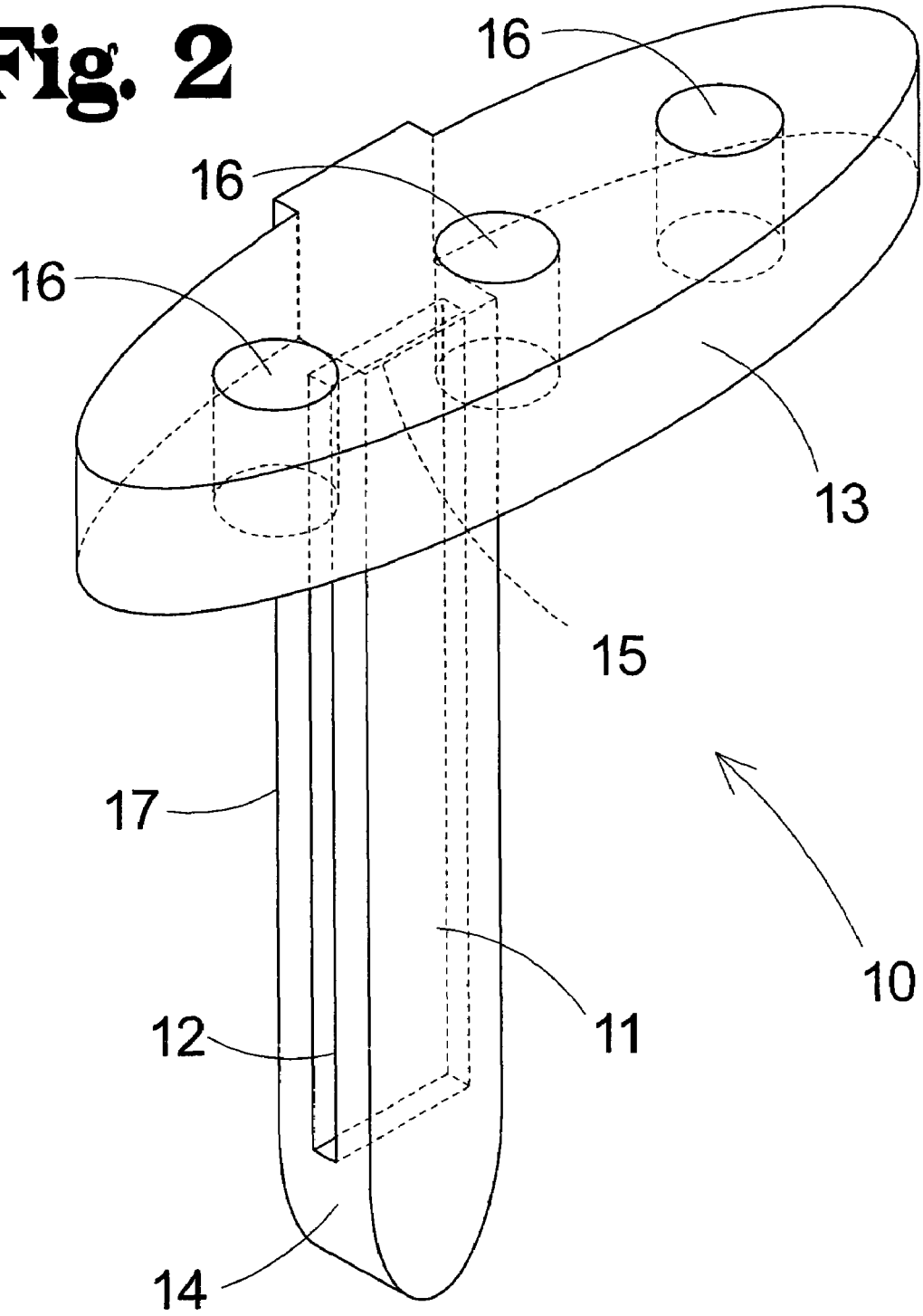
FIG. 2 is a perspective view of the tee holding device.
Figure 5:
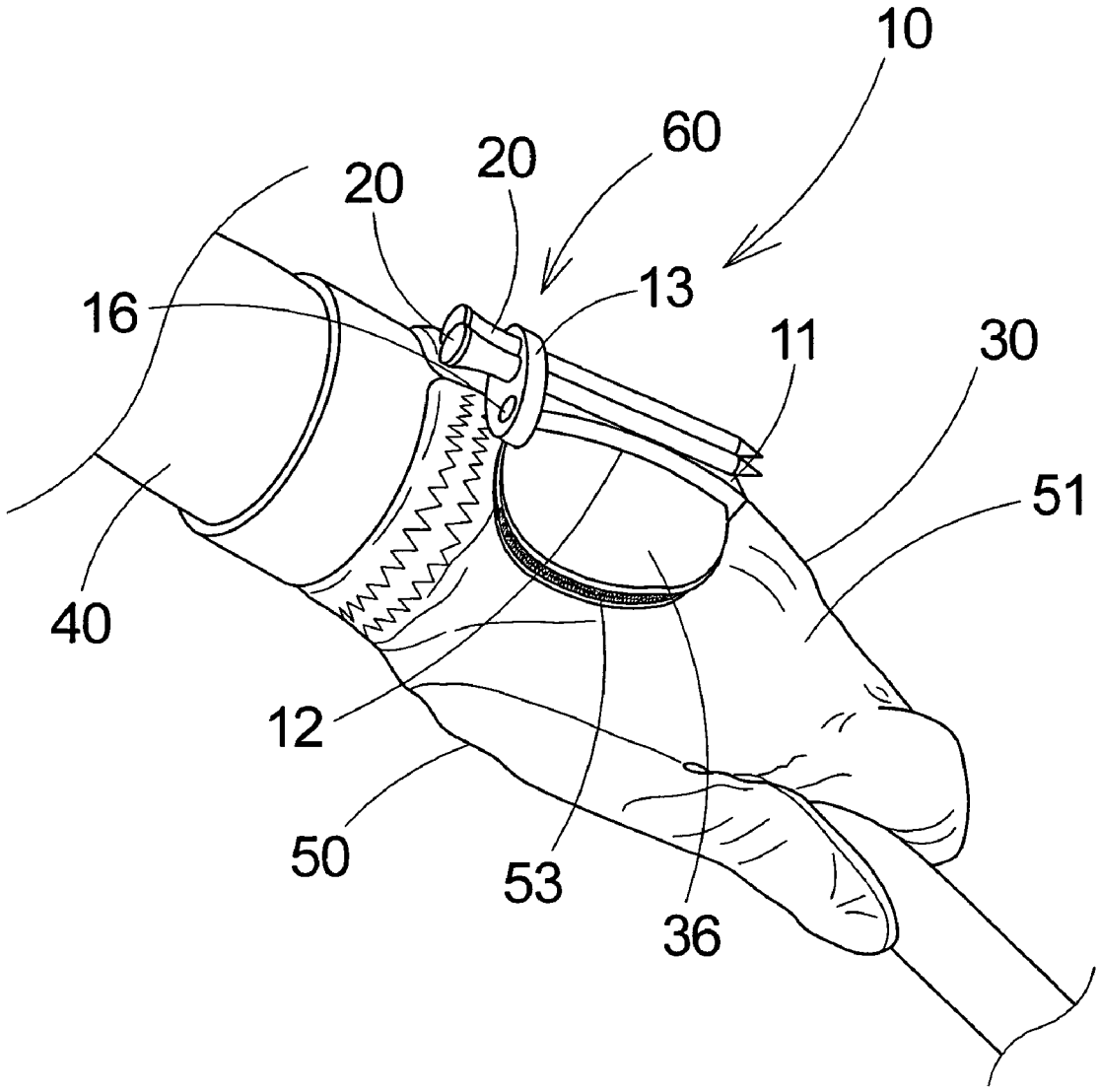
FIG. 5 is an in use view of the glove mounted tee holding system mounted on a gloved hand.

As best illustrated in FIGS. 1, 2 and 5, the system 10 for holding golf tees on a hand of a golfer is highly suitable for use on a glove 30 of the type having a front portion 50 for positioning adjacent to a palm side of the hand of the golfer when worn and a back portion 51 for positioning adjacent to a back side of the hand of the golfer when worn. The glove 30 includes an opening edge 31 that defines an opening 40 for receiving the hand of the golfer. The glove 30 further includes a slit edge 32 that defines an expansion slit 33 for permitting expansion of the opening and may be oriented perpendicular to the edge 31 of the opening. The slit 33 is located on the back portion 51 of the glove, and has a first slit section 34 and a second slit section 36. Each slit section 34, 36 may be oriented substantially parallel to each other, and substantially perpendicular to the opening edge. Each section 34, 37 of the slit edge 32 has an opposite end. The first slit section 34 and second slit section 37 each converge with the opening edge 35. The second ends of the first slit section 34 and the second slit section 37 converge together adjacent to the front portion 50 of the glove 30.

The glove 30 has a securing flap 36 for selectively securing together sections of the back portion 51 of the glove. The securing flap 36 is located on one of the opposite sides of the expansion slit edge 32. The flap 36 may be irremovably secured to a first one of the sections of the back portion of the glove 37 and may be removably fastened to a second one of the sections of the back portion of the glove 30. The securing flap 36 has an outer face and an inner face, and also has a perimeter edge.

Figure 4:
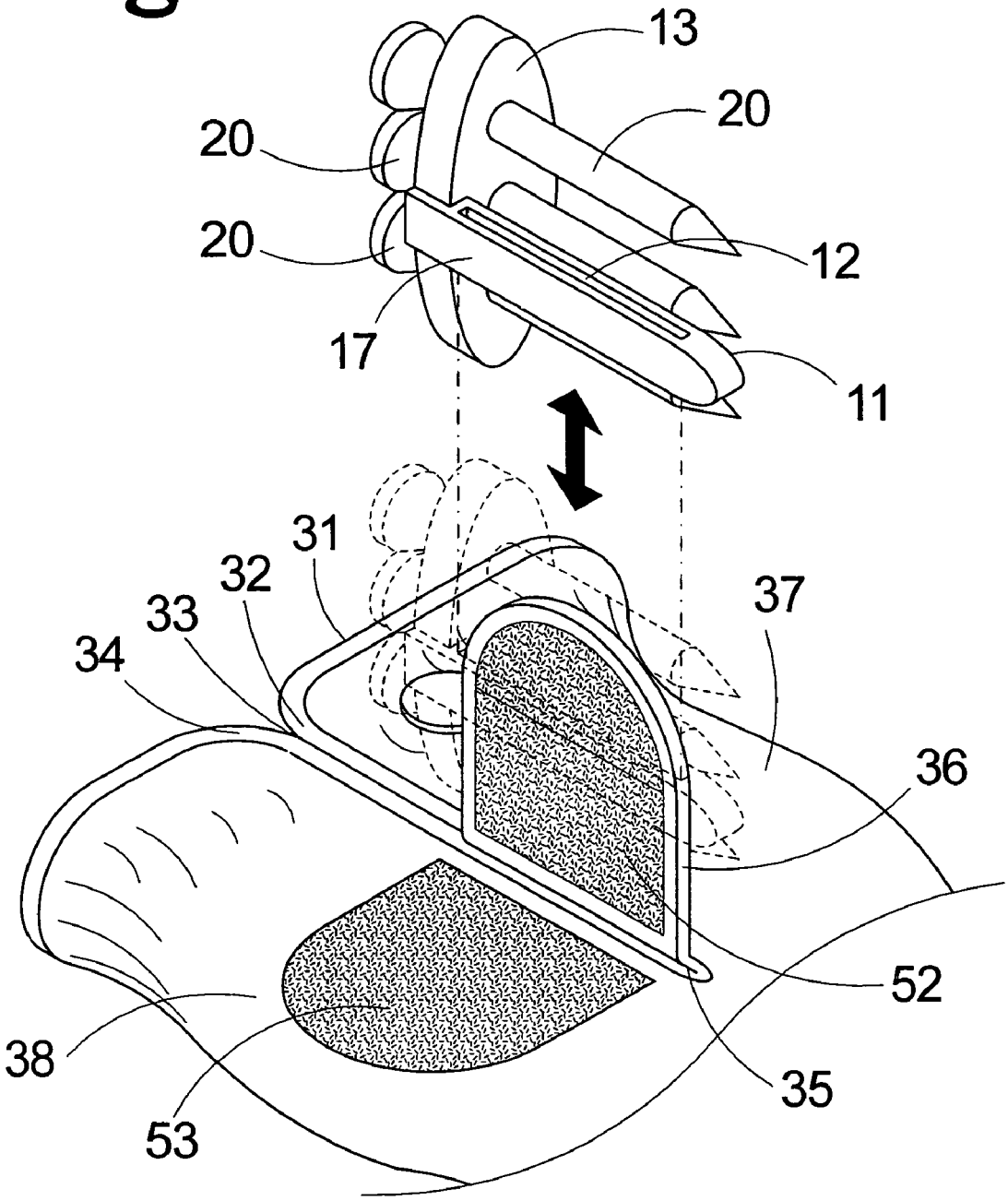
FIG. 4 is a perspective view of the glove mounted tee holding system mounted on a golf glove with the securing strap detached.

In FIG. 4, a fastening apparatus is shown that removably fastens the securing flap 36 to the second section of the back portion of the glove 38. The fastening apparatus is located on the inner face of the securing flap and the back portion 51 of the glove. The apparatus comprises a first component 52 mounted on the securing flap 36 and a second component 53 mounted on the second section of the back portion 38. In some embodiments, the fastening apparatus may comprise hook and loop fastener components such that a first component 52 of the hook and loop fastener components is mounted on the securing flap 36 and the second component 53 of the hook and loop fastener components is mounted on the second section of the back portion 51.

Figure 3:
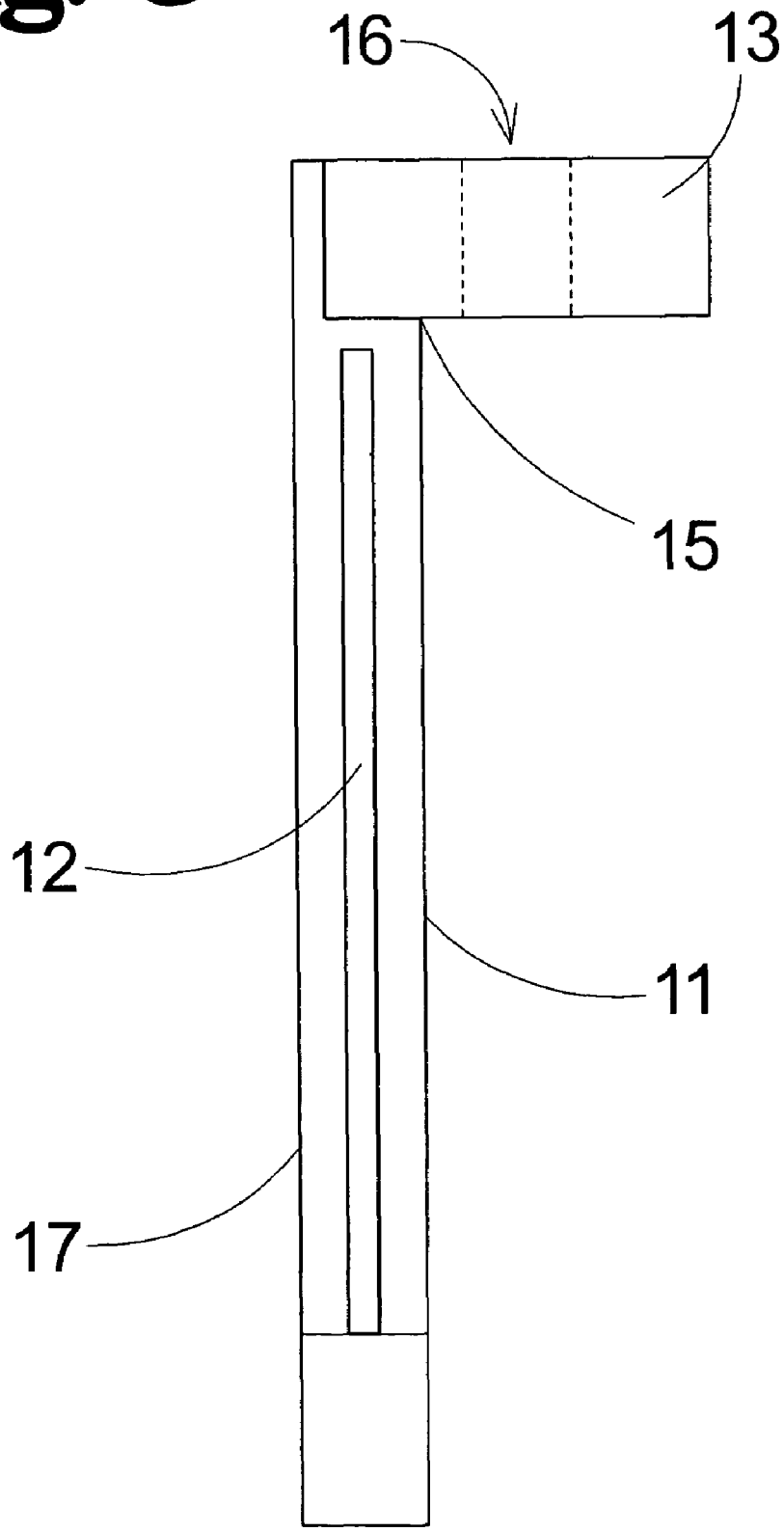
FIG. 3 is a left side elevational view of the tee holding device.

In FIGS. 1 and 3, a tee holding device 60 is removably mounted on the securing flap 36 of the glove 30. The tee holding device 60 removably receives a portion of the securing flap 36 in an elongate slot 12. The tee holding device 60 comprises an elongate slot 12 mounting portion for mounting on the securing flap 36. The elongate slot 12 is closed at both ends. The elongate slot 12 comprises a first section 11 and a second section 17, wherein the first section 11 and the second section 17 define the slot 12 therebetween. The first 11 and second 17 sections each have opposite ends. The respective opposite ends of the first 11 and second 17 sections are connected together to form the closed ends of the slot. The first 11 and second 17 sections are elongate and may be oriented substantially parallel to each other. The elongate mounting portion 14 has a longitudinal axis. The slot 12 preferably has a length that is substantially equal to a width of the securing flap 36.

The tee holding device includes a tee receiving portion 13 for removably receiving one or more golf tees 20. The tee receiving portion 13 is mounted on mounting portion 14 and is defined by at least one aperture 16 for removably receiving a tee 20. When more than one aperture 16 is used to store multiple tees, the apertures may be positioned along a line, and the line may be oriented parallel to the longitudinal axis of the tee receiving portion 13 and substantially parallel to the outer face of the securing flap 36 when the securing flap 36 is positioned in the slot 12. The tee receiving portion 13 may be elongate, with the longitudinal axis of the receiving portion 13 being oriented substantially perpendicular to the longitudinal axis of the mounting portion 14.

The tee receiving portion 13 may have an inner edge and an outer edge. The inner edge may be oriented toward the glove 30 when the securing flap 36 of the glove is positioned in the slot 12 and is located adjacent to the mounting portion 14. The mounting portion 14 extends across the securing flap 36 of the glove when the tee holding device 60 is mounted on the glove 30. One of the sections of the mounting portion 14 extends across one of the components of the fastener structure so that fastening the first and second components of the fastener structure helps to hold the mounting portion 14 of the tee holding device 60 in place.

In use, a user places a hand inside glove 30 through the opening edge 31. The user then slides the securing flap 36 of the glove 30 through the elongate slot 12 in the mounting portion 14 of the tee holding device 60. By cinching the securing flap 36 tight and pressing the first component of the fastening means on the back portion of the securing flap 36 into contact with the second component of the fastening means on the second section 38 of the back portion 51, the fastening means engage one another. Once engaged, the attachment means holds the securing flap 36 in place, securing the golf glove 30 to the hand 40 and also securing the tee holding device 60 to the securing flap 36.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for holding golf tees on a glove for a hand of a golfer, the glove being of the type including a securing flap for selectively securing together sections of a back portion of the glove located on opposite sides of an expansion slit, the system comprising:

a tee holding device removably mounted on the securing flap of the glove, the tee holding device removably receiving a portion of the securing flap of the glove, the tee holding device comprising:

a mounting portion for mounting on the securing flap of the glove, the mounting portion forming an elongate slot configured to removably receive the securing flap of the glove, the elongate slot being closed at both ends; and a tee receiving portion mounted on the mounting portion for removably receiving at least one golf tee, the tee receiving portion including at least one aperture for removably receiving a golf tee;

wherein the mounting portion comprises a first section and a second section, the first section and the second section define the slot therebetween, the first and second sections each having opposite ends, the respective opposite ends of the first and second sections being connected together to form the closed ends of the slot.

2. The apparatus of claim 1, wherein the first and second sections are oriented substantially parallel to each other.

3. The apparatus of claim 1, wherein the mounting portion is elongate with a longitudinal axis and the tee mounting portion is elongate with a longitudinal axis, the elongate tee receiving portion being oriented substantially perpendicular to the longitudinal axis of the mounting portion.

4. The apparatus of claim 1, wherein the tee receiving portion includes at least two apertures.

5. The apparatus of claim 4, wherein the at least two apertures are positioned substantially in a line.

6. The apparatus of claim 5, wherein the line is oriented substantially parallel to a longitudinal axis of the tee receiving portion.

7. The apparatus of claim 1, wherein the tee receiving portion has an inner edge and an outer edge, the inner edge being oriented toward the glove when the securing flap of the glove is positioned in the slot, the mounting portion being located adjacent to the inner edge of the tee receiving portion.

8. The apparatus of claim 1, wherein the mounting portion extends across the securing flap of the glove when the tee holding device is mounted on the glove.

9. A system for holding golf tees on a hand of a golfer, comprising:

a glove including:

an opening edge defining an opening for receiving the hand of the golfer;

a slit edge defining an expansion slit in communication with the opening for permitting expansion of the opening; and a securing flap for selectively securing together sections of the glove located on opposite sides of the expansion slit to resist expansion of the opening;

a tee holding device removably mounted on the securing flap of the glove, the tee holding device defining a slot removably receiving a portion of the securing flap of the glove to removably mount the tee holding device on the glove, the tee holding device comprising:

a mounting portion for mounting on the securing flap of the glove, and a tee receiving portion for removably receiving at least one golf tee, the tee receiving portion being mounted on the mounting portion;

wherein the mounting portion comprises a first section and a second section; and wherein the first section and the second section define the slot therebetween, the first and second sections each having opposite ends, the respective opposite ends of the first and second sections being connected together to form the closed ends of the slot.

10. The system of claim 9, wherein the securing flap is irremovably secured to a first one of the sections of the back portion of the glove and being removably fastened to a second one of the sections of the back portion of the glove.

11. The system of claim 9, further comprising fastening means for removably fastening the securing flap to the second section of the back portion of the glove.

12. The system of claim 11, wherein the fastening means is located on the inner face of the securing flap and the back portion of the glove, the fastening means comprising a first component mounted on the securing flap of the glove and a second component mounted on the second section of the back portion.

13. The system of claim 9, wherein the mounting portion defines the slot and the slot is closed at both ends.

14. The system of claim 9, wherein the first and second sections are elongate and are oriented substantially parallel to each other, the first and second sections being elongate.

15. The system of claim 9, wherein the mounting portion is elongate with a longitudinal axis and the tee receiving portion is elongate with a longitudinal axis, the longitudinal axis of the tee receiving portion being oriented substantially perpendicular to the longitudinal axis of the mounting portion.

16. The system of claim 9, wherein the slot has a length between ends, the length being substantially equal to a width of the securing flap.

17. The system of claim 9, wherein the tee receiving portion defines at least one aperture for removably receiving a tee.

18. A system for holding golf tees on a glove for a hand of a golfer, the glove being of the type including a securing flap for selectively securing together sections of a back portion of the glove located on opposite sides of an expansion slit, the system comprising:

a tee holding device configured to removably receive a portion of the securing flap of the glove to thereby mount the tee holding device on the glove, the tee holding device comprising:

a mounting portion for mounting on the securing flap of the glove, the mounting portion forming an elongate slot configured to removably receive the portion of the securing flap of the glove, the elongate slot being closed at both ends;

a tee receiving portion mounted on the mounting portion and including at least one aperture configured to removably receive a golf tee; and wherein the mounting portion comprises a first section and a second section, the first section and the second section define the slot therebetween, the first and second sections each having opposite ends, the respective opposite ends of the first and second sections being connected together to form the closed ends of the slot.

* * * * *